United States Patent [19]

Sneed

[11] 4,014,357

[45] Mar. 29, 1977

[54] BEAKER STEAMER

[76] Inventor: Allen L. Sneed, Lot 59 Woodville Manor, Magnolia, Del. 19962

[22] Filed: Dec. 15, 1975

[21] Appl. No.: 640,763

[52] U.S. Cl. ..... 134/102; 134/113; 134/171

[51] Int. Cl.[2] ..... B08B 3/02; B08B 9/08

[58] Field of Search ..... 134/102, 152, 166 R, 134/171, 200, 94–95, 100–101, 113, 169 R

[56] References Cited

UNITED STATES PATENTS

| | | | |
|---|---|---|---|
| 695,446 | 3/1902 | Doherty | 134/171 |
| 1,584,913 | 5/1926 | Wilson | 134/102 |
| 2,811,975 | 11/1957 | Tatibana | 134/102 |
| 3,156,584 | 11/1964 | Yurdin | 134/102 X |
| 3,276,694 | 10/1966 | Alexander | 134/102 X |

FOREIGN PATENTS OR APPLICATIONS

| | | | |
|---|---|---|---|
| 159,845 | 7/1954 | Australia | 134/95 |

*Primary Examiner*—Robert L. Bleutge

[57] ABSTRACT

This device consists primarily of a pressurized cabinet, in which steam, under pressure, is mixed with a suitable solvent for effectively cleaning various types of vessels, such as beakers. The device includes a metering gauge and a metering valve within the line extending from the solvent tank, and the steam line has secured therein, a safety solenoid valve which is energized by a plunger type safety switch.

1 Claim, 2 Drawing Figures

BEAKER STEAMER

This invention relates to devices for cleaning various types of vessels, and more particularly to a beaker steaming device.

It is therefore the principal object of this invention to provide a beaker steaming device which will employ pressurized steam mixed with a specified quantity of solvent, stoddard solvent, kerosene, etc.

Another object of this invention is to provide a beaker steaming device in which the solvent and steam is sprayed up into a beaker,test tube, viscosimeter tube or other vessel, by means of jets enclosed in a pressurized cabinet.

A further object of this invention is to provide a device of the type described, which, during the cleaning operation, will keep the glass vessels hot.

Other objects of the invention are to provide a beaker steaming device, which is simple in design, inexpensive to manufacture, rugged in construction, easy to use and efficient in operation.

These and other objects will be readily evident upon a study of the following specification and the accompanying drawing, wherein.

Figure 1:
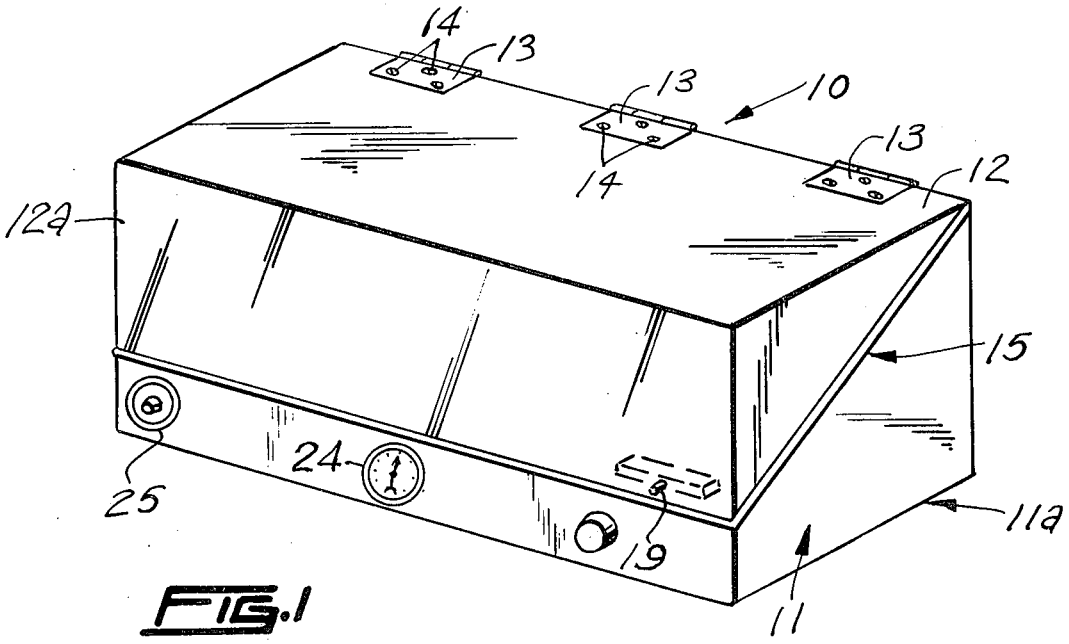
FIG. 1 is a perspective view of the present invention.
Figure 2:
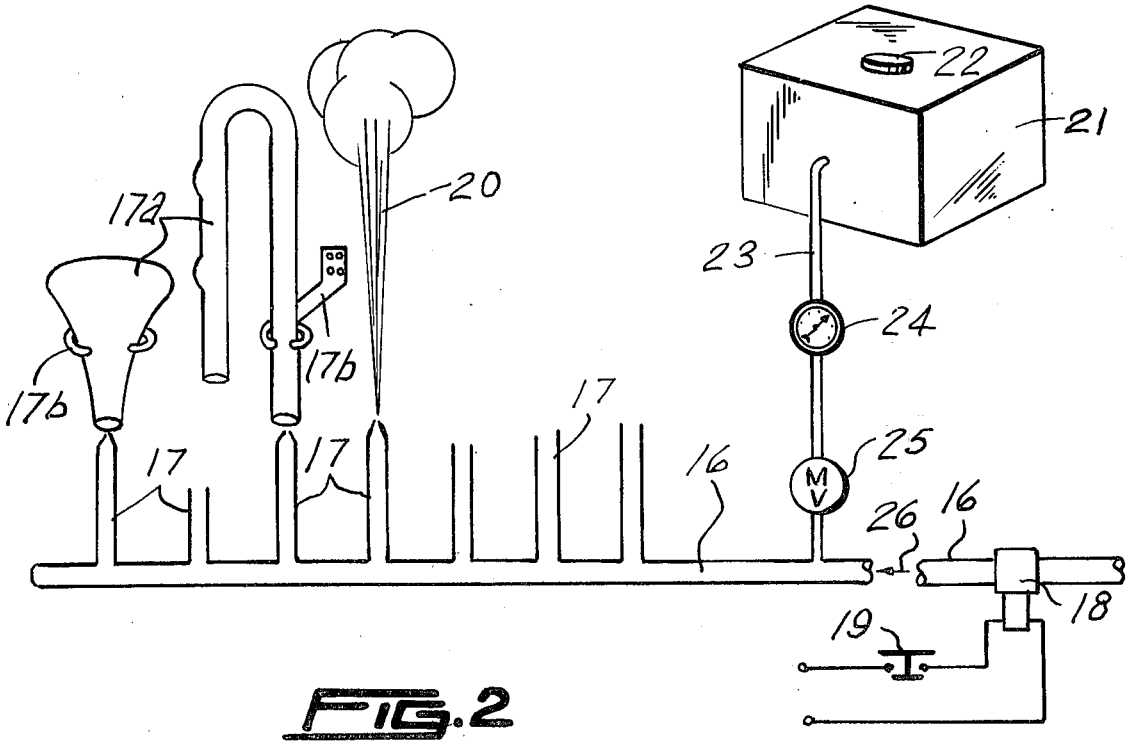
FIG. 2 is a diagrammatic view of the invention shown removed from the enclosure of FIG. 1.

According to this invention, a beaker steaming device 10 is shown to consist of a rectangular configurated housing 11 to which is secured, a cover 12 by a plurality of spaced apart hinges 13. The hinges 13 are secured to the cover 12 and the rear of the housing 11, by suitable fasteners 14. The front portion of cover 12 has secured thereto a heat resistant glass 12*a* and housing 11 is provided with a seal 15 between the upper edges of base 11*a* and the lower edges of cover 12, so as to enable pressure to be maintained on the interior of device 10.

A pipe 16 on the interior of housing 11 is provided with parallel spaced apart steam jets 17 which are in alignment with the openings of vessels 17*a* which are supported within brackets 17*b.* At the steam under pressure entrance portion of pipe 16, is located, a safety solenoid valve 18, which is actuated by means of plunger type safety switch 19, wired in series with safety solenoid valve 18. The pressurized steam and solvent mixture as indicated by the numerical character 20, is emitted from the jet 17, into the vessels 17*a* which are suspended within housing 11. The solvent tank 21 is external of housing 11 and is refillable by means of cap 22. Pipe 23 extending from solvent tank 21 has secured therein a metering gauge 24 and a metering valve 25, the pipe 23 being secured behind solenoid valve 18 and the steam under pressure, flow is indicated by the arrow 26.

What I now claim is:

1. A beaker steaming device, comprising a safety solenoid valve secured within a horizontal pipe carrying steam and having plunger type safety switch means, said switch means is actuated to stop the high pressure steam flow within said horizontal pipe and said horizontal pipe is provided with a plurality of spaced apart jets for directing a mixture of steam and solvent, into the openings of vessels to be cleaned, said vessels being received removably within bracket means fixedly secured to the back wall of a housing, and line means from a solvent tank is secured fixedly to said horizontal pipe and has secured therein metering gauge means for controlling the flow of said solvent to said pipe carrying said steam.

* * * * *